US006322384B1

(12) United States Patent
Ikeya

(10) Patent No.: US 6,322,384 B1
(45) Date of Patent: Nov. 27, 2001

(54) ELECTRICAL SOCKET APPARATUS

(75) Inventor: Kiyokazu Ikeya, Shizuoka (JP)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/706,379

(22) Filed: Nov. 3, 2000

(30) Foreign Application Priority Data

Dec. 24, 1999 (JP) ..... 11-366574

(51) Int. Cl.[7] ..... H01R 13/62
(52) U.S. Cl. ..... 439/331; 439/330
(58) Field of Search ..... 439/330, 331, 439/264, 266, 70, 71

(56) References Cited

U.S. PATENT DOCUMENTS 5,697,795 * 12/1997 Abe ..... 439/266
5,718,595 * 2/1998 Tohyama et al. ..... 439/330
5,752,846 * 5/1998 Abe ..... 439/266
5,865,639 2/1999 Fuchigami et al. ..... 439/330

* cited by examiner

*Primary Examiner*—Tho D. Ta
(74) *Attorney, Agent, or Firm*—Russell E. Baumann; Frederick J. Telecky, Jr.

(57) ABSTRACT

A socket (10) includes an adaptor (28) which has a seating surface (28*b*) for an IC (100) and which has a plurality of contact member receiving holes (28*d*) in the seating surface. The tips (14*c*) of a plurality of contact members (14) are received through the contact member receiving holes (28*d*) of the adaptor, with contact established with each respective terminal (101) of the IC (100) that has been placed on the seating surface. The IC on the seating surface is held by means of rotary latches (22). The latches (22) have an opened position for placement of the IC on the seating surface of the adaptor and a closed position for holding the IC from above it, rotating about a shaft (32) fixed to the base. A cover (20) is movable between first and second positions and a links (24) connected to the cover (24) open the latches when the cover is at a first position and close the latches when the cover is at a second position.

12 Claims, 15 Drawing Sheets

ELECTRICAL SOCKET APPARATUS

FIELD OF THE INVENTION

This inventions relates generally to a socket suitable for removably receiving an electrical part such as an integrated circuit (IC) having a plurality of terminals of the LGA or BGA, etc., type and more particularly to a socket for use in a burn-in test of the IC.

BACKGROUND OF THE INVENTION

Various tests are conducted for the purpose of identifying and discarding those IC packages that do not meet the required specifications for newly manufactured semiconductor integrated circuits. The burn-in procedure tests the IC's heat resistance properties by causing them to perform for a certain period of time at high temperature, thereby making it possible to cull out those that do not meet the required specifications. In a burn-in test, the IC is mounted on the socket that has been prepared exclusively for that purpose and the socket is in turn mounted on a printed circuit substrate for placement in a heating oven. Various kinds of sockets have been proposed for use in burn-in tests of IC packages of the LGA (Land Grid Array) or BGA (Ball Grid Array) types which have become popular in recent years. Basically, such sockets have a base member made of an insulating material and have a plurality of contact members that correspond to the terminals arranged on one surface of the IC. The contact members are arranged on the seating surface of the socket to correspond to each terminal of the IC to be brought in touch with the same when the IC has been placed on the seating surface. In a typical kind of socket, a cover is provided for holding the IC on the seating surface, with the IC being held on and removed from the seating surface by moving the cover up and down.

With reference to FIGS. 13 and 14, one such prior art socket has one side of a cover 142 rotatably supported on a base 141. When cover 142 is opened as shown in FIG. 14, IC 100 is placed onto seating surface 141*a* and cover 142 is closed by means of an automatic unit, not shown in the drawing. A hook 143 is engaged with a latch on base 141 to maintain cover 142 in a closed position. IC 100 on seating 141*a* is compressed from above by a compression surface 142*a* inside cover 142, with the terminals of the IC brought into engagement with the tip of respective contact members.

A problem with this type of socket is that when closing cover 142, compression surface 142*a* approaches the base in a way which is inclined Is relative to IC 100 with a result that a bias load is applied to the IC. This biased load can damage the IC itself and, at the same time, can result in an uneven compressive force of the contact elements 144 against the terminals of the IC. In addition, the construction of the automatic unit for the switching action of cover 142 is complicated.

Another type of prior art socket is equipped with a mechanism for the vertical movement of the cover member relative to the base member and a latch that opens or closes in linkage with the movement of the cover. It is generally the case that the latch opens when the cover member is lowered, thereby making it possible for the IC to be placed on the seating surface of the base and closes when the cover member is elevated, thereby making it possible for the IC on the seating surface to be held from above.

This type of socket is subject to the following limitations:

(1) The latch needs to have its holding portions extend onto the upper surface of the IC when it is closed and recede from the upper surface of the IC hen it is opened. In order to realize this mechanism, usually a latch and a driving mechanism therefor are arranged around the seating surface of the IC. Because of this, there is a tendency to increase the external size of the socket.

(2) This type of socket for use in burn-in tests has a comparatively large number of parts requiring much time for its assembly.

(3) In this type of socket, the contact members have a curved part pressed against the terminals of the IC with a spring force based on the bending of the curved part when they are pressed. Along with an ever-increasing density of the IC terminals, there is a concomitant demand for the socket to have a contact member with high connective reliability.

SUMMARY OF THE INVENTION

Accordingly, it is an object of the invention to provide a socket whose outside shape is comparatively small relative to the size of the IC that is to be tested. Another object of the invention is the provision of a socket which is easily and quickly assembled. Still another object of the invention is the provision of a socket having increased reliability of contact engagement of contact members with the terminals of the IC.

The invention relates to a socket for use with an IC having a plurality of terminals on at least one surface thereof. A socket made according to the invention has a seating surface for the IC on an adaptor received on a base with the adaptor being provided in such a way as to have a plurality of contact member receiving holes on the seating surface. The tips of a plurality of contact members corresponding to the terminals of the IC are received through the contact member receiving holes of the adaptor, thereby establishing contact with each terminal of the IC that has been placed on the seating surface. The IC on the seating surface is held by means of a rotary latch having a shaft fixed to the base. The latch has an open position for placement of the IC on the seating surface of the adaptor and a closed position for holding the IC on the seating surface from above the IC. The socket has a cover arranged over the base and a linking member that links the cover and the latch. The cover is supported for movement between a first position which is close to the base and a second position which is removed from the base. The linking member opens the latch when the cover is at the first position and closes the latch when the cover is at the second position.

In a preferred embodiment of the invention, the rotary shaft of the latch is positioned below the seating surface of the adaptor. The cover preferably is normally biased away from the base to its second position. In this connection, preferably the straight line distance between the connecting point of the linking member and the latch and the rotary shaft of the latch varies in conformity with the position of the cover. In a specific example, the connecting point is guided by a slot formed in the latch which is elongated generally in the direction of the rotary shaft. Preferably, a guide is provided on the base so that the connecting point will be guided to a position which is close to the rotary shaft of the latch when the latch is opened and to a position which is away from the rotary shaft of the latch when the latch is closed. The base preferably has four sides, with a latch being provided adjacent to two opposed sides. It is desirable for the adaptor to comprise an assembly having a fixed mounting block, a movable adaptor member and spring members. The mounting block is fixed to the base for holding a plurality of contact members. The adaptor member has a seating surface for an IC device and is movably disposed on the mounting block, the adaptor member receiving the plurality of contact members within the seating surface and being supported in such a manner as to be in contact with or separated from the mounting block and the spring members bias the adaptor member in a direction away from the mounting block.

The plurality of contact members each has a tip part that contacts a respective terminal of a semiconductor device placed on the seating surface and a curved part that provides a compressive force to the tip part against the terminal, some of the plurality of contact makers having the curved parts arranged to extend in a first direction and others having the curved parts arranged to extend in a second direction. Preferably, approximately one half of the plurality of contact members have their curved parts arranged to extend in the first direction and approximately the remaining half have the curved part arranged to extend in the second direction. Preferably, the first direction and the second direction are opposite to each other. The plurality of contact members are preferably arranged in a plurality of rows and their curved parts face in a single direction within a row.

These and other objects and features of the invention will be apparent from the following description taken with reference to the accompanying drawings.

DETAILED DESCRIPTION OF THE PREFERRED EMBODIMENT

Figure 1A:
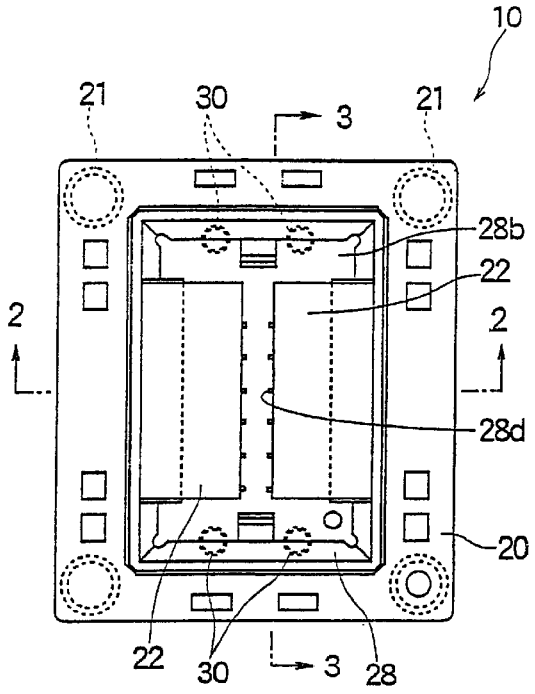
FIG. 1A is a top plan view of an electrical socket made in accordance with the invention.

The preferred embodiment of the invention will be explained below with reference to FIG. 1A through FIG. 12. Socket 10 is made basically by incorporating an adaptor assembly 16 (see FIG. 2), including contact members 14, into a base assembly 12. Base assembly 12 comprises a base 18, shaped in a suitable configuration, such as rectangular when viewed from above, formed of an electrically insulating material such as plastic. Base 18 has a recessed part 18*a* for receiving adaptor assembly 16 in the center of the base. The lower part of contact members 14 protrude from the lower surface of the base through holes 18*b* when the adaptor assembly is inserted into recess 18*a*. Socket 10 is placed on a printed circuit substrate, not shown in the drawing, and each contact member 14 is electrically connected to the circuit pattern on the substrate.

Figure 1C:
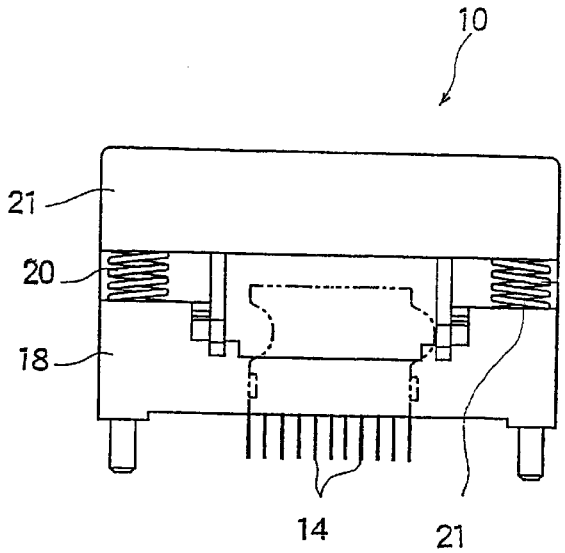
FIG. 1B is a front elevational view thereof and FIG. 1C is a side elevational view of the FIG. 1A socket.
Figure 1B:
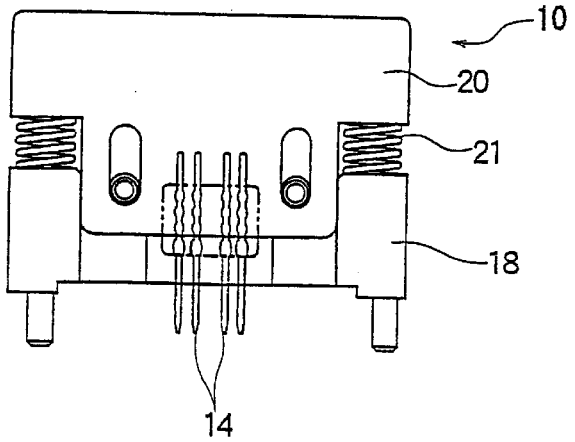
Figure 2:
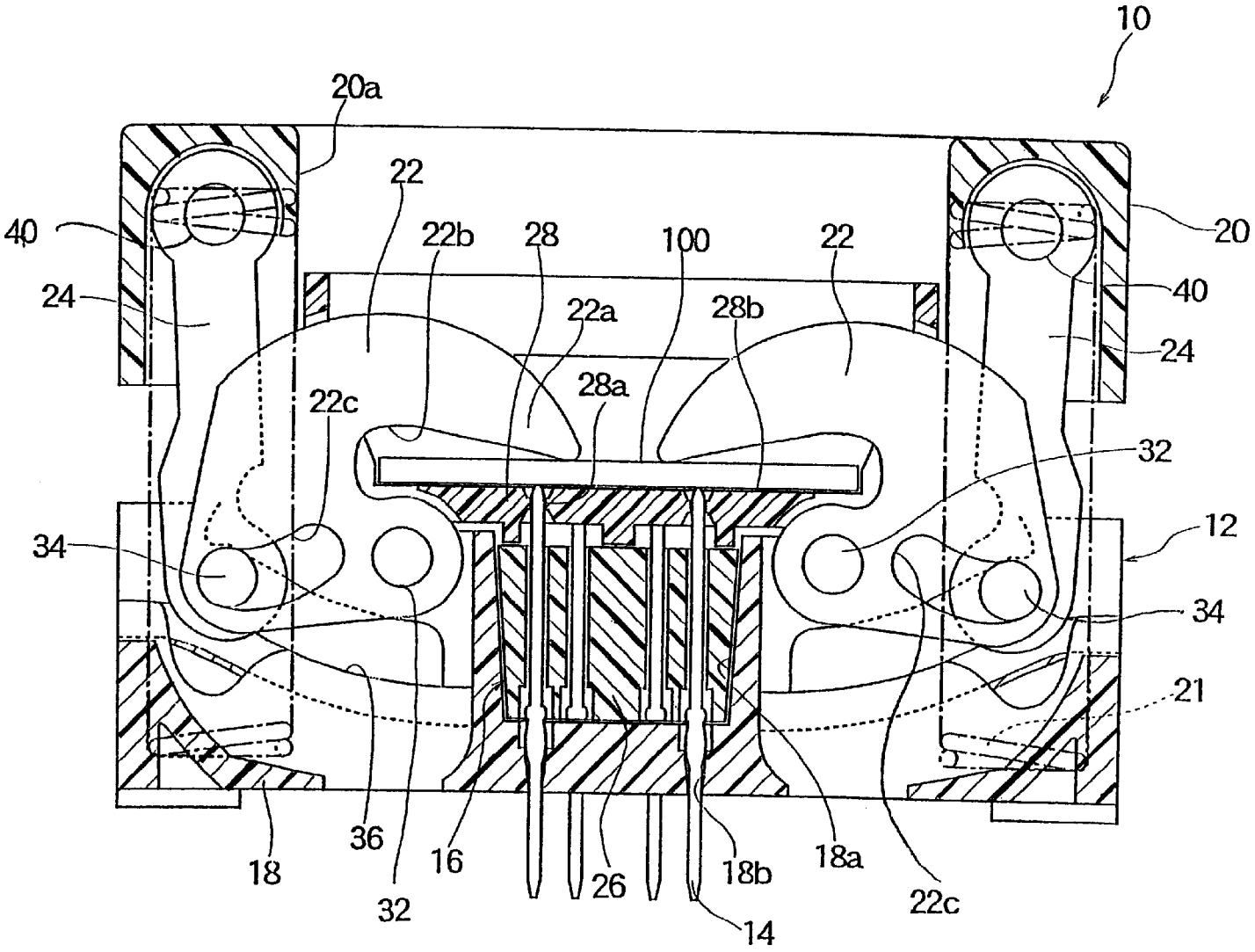
FIG. 2 is a cross sectional view taken along line 2—2 in FIG. 1A showing an IC held thereon.

Base assembly 12 also includes a cover 20, shaped in correspondence with base 18, formed of an electrically insulating material such as plastic. Cover is movably mounted on base 18 toward and away from the base in a perpendicular direction. The center of cover 20 is formed with an opening 20*a* to permit insertion of IC 100 from above the socket. Four springs 21 are arranged at the corners of the socket between base 18 and cover 20 to bias the cover away from the base as shown in FIGS. 1B, 1C and 2. That is, the force of springs 21 cause cover 20 to normally assume a position which is raised relative to base 18. When the cover is raised, an outwardly extending stop surface 18*d* of base 18 and an inwardly extending stop surface 20*b* of the cover are engaged (see FIG. 3). Cover 20 is linked to base 18 through a pair of latches 22 and four links 24 that are included in base assembly 12. The function of latches 22 is to fix or hold an IC 100 that has been placed inside socket 10. The latches are rotatable between an opened position and a closed position in linkage with vertical movement of cover 20 by means of links 24. Details of the latches 22 and their operation will be described below.

Figure 3:
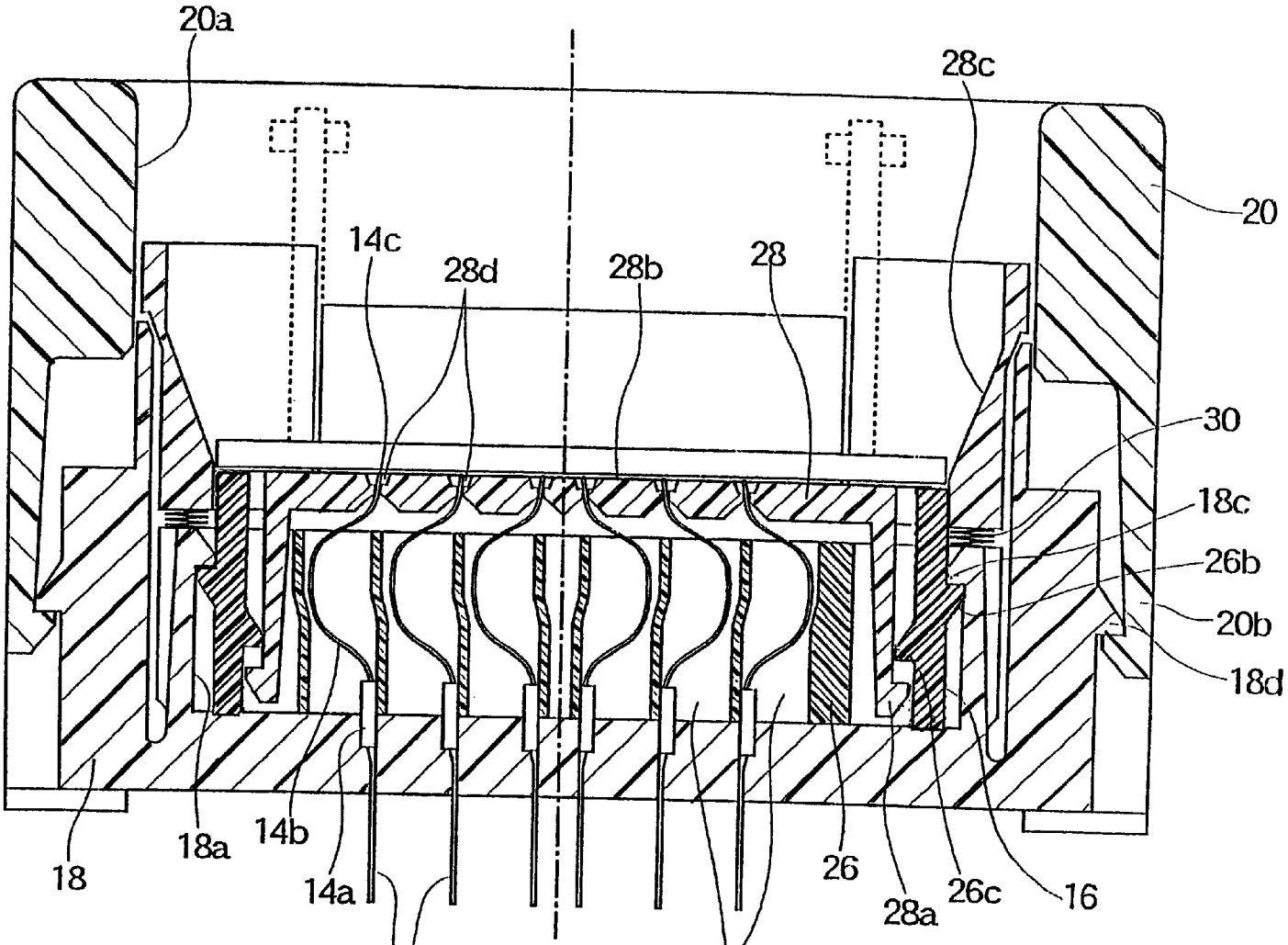
FIG. 3 is a cross sectional view taken along line 3—3 in FIG. 1A as specifically modified in FIG. 8 showing an IC held thereon.
Figure 5:
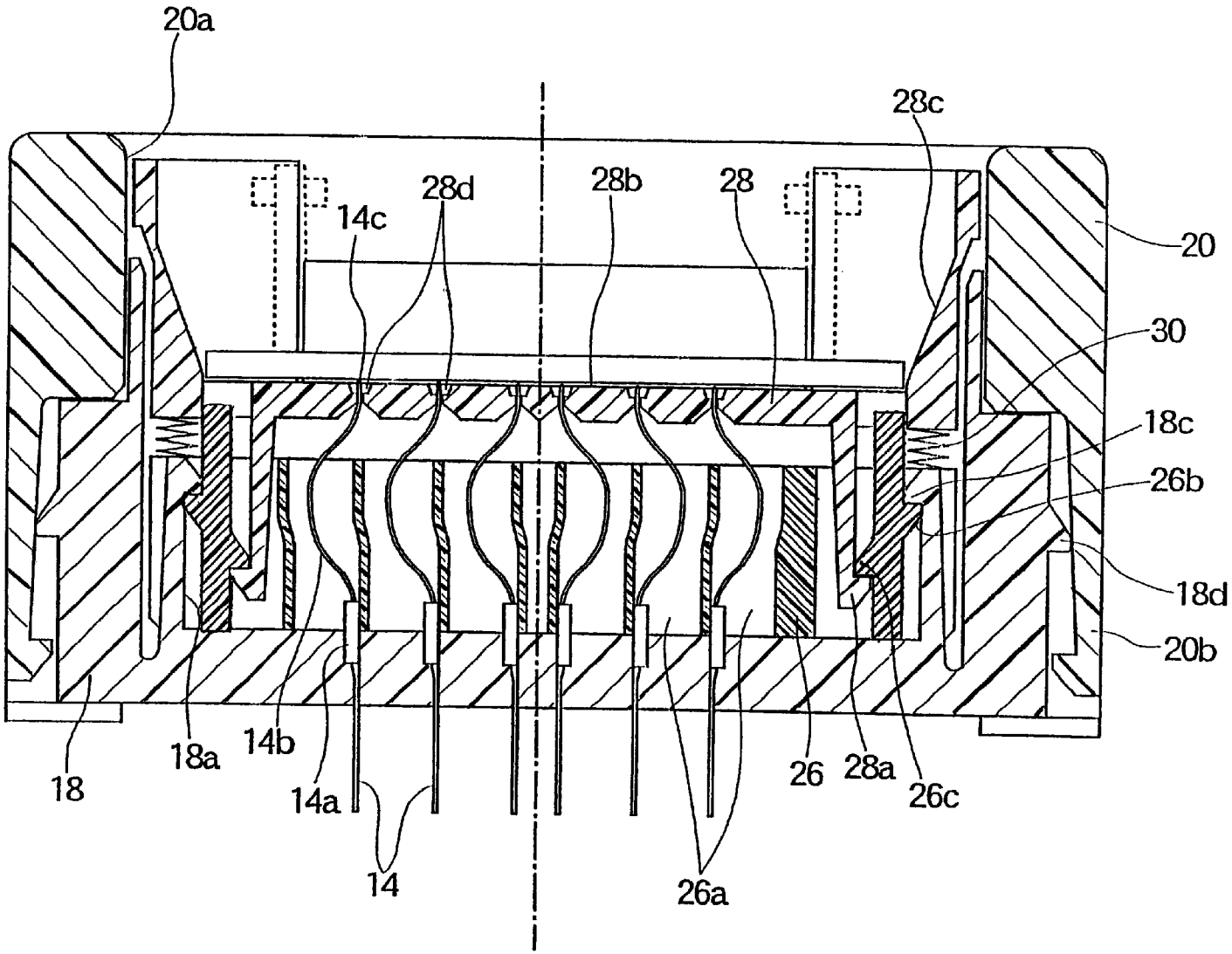
FIG. 5 is a view similar to FIG. 3 but showing the FIG. 1A socket with the IC released.

Adaptor assembly 16 includes contact members 14, whose number and placement correspond to the number and placement of terminal pads 101 of an IC 100 that is to be tested (see FIG. 6), a mounting block 26 that holds contact members 14 and an adaptor member 28 that is placed thereon. Mounting block 26 is made of an electrically insulating material such as plastic and has slots 26*a* for receipt of respective contact members 14 running vertically through the slots. Each contact member 14 is engaged and held at the lower portion of a hole 18*b* at an engagement part 14*a* which is located approximately at the center of the contact member. As shown in FIGS. 3 and 5, slots 26*a* are formed having an expanded width to allow curved part 14*b* of the contact members to freely assume a curved configuration therein. An engagement latch 26*b* is formed on the outer peripheral wall of mounting block 26 which is engaged with engagement latch 18*c* of base 18 to fixedly attach mounting block 26 to base 18. Further, an inwardly extending engagement latch 26*c* is formed on the mounting block 26 and this engages with an outwardly extending engagement latch 28*a* of adaptor member 28.

Figure 7B:
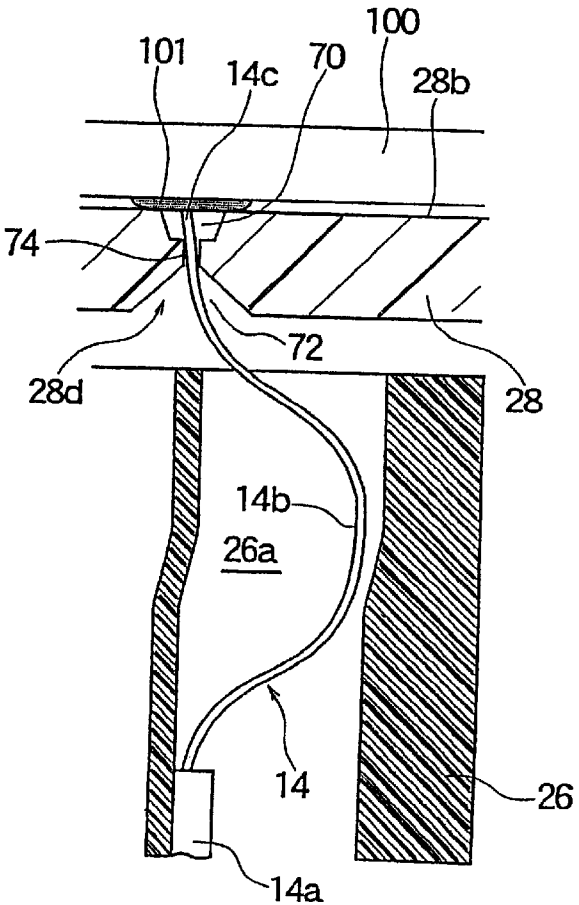
FIGS. 7A and 7B are enlarged portions of FIGS. 5 and 3 respectively shown for the purpose of explaining the operation of the contact members.
Figure 7A:
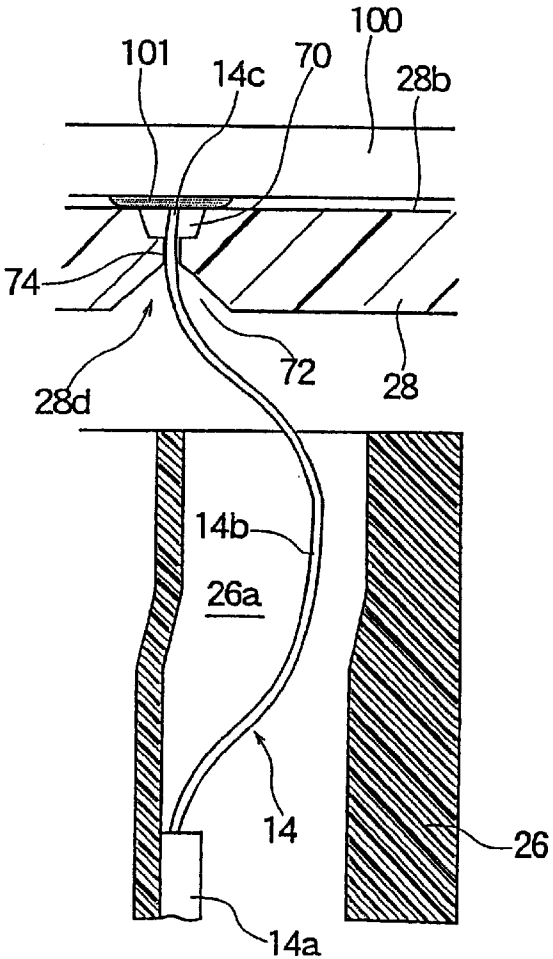

Adaptor member 28 is made of an electrically insulating material such as plastic and is arranged on mounting block 26. Adaptor member 28 is vertically movable relative to mounting block 26 having a comparatively small stroke. Four coil springs 30 are placed between the base and adaptor member 28 to bias the adaptor member upwardly relative to mounting block 26. When adaptor member 28 is raised, as shown in FIG. 5, engagement latch 26*c* of mounting block 26 and engagement latch 28*a* of adaptor 28 are engaged with each other thereby limiting the stroke of movement. Adaptor member 28 has a seating surface 28*b* for IC 100 on its upper surface. Seating surface 28*b* corresponds to the generally planar lower surface of IC 100, with its periphery being defined by the lower end of wall 28*c*. Accordingly, an IC 100 that has been placed on seating surface 28*b* has its approximate position determined by wall 28*c*. As shown in FIGS. 7A and 7B, receiving holes 28*d* are located on seating surface 28*b* of adaptor 28 in conformity with the position of pads 101 of IC 100. Tip 14*c* of each respective contact member 14 mounted in mounting block 28 protrudes slightly from a receiving hole 28*d* and it contacts a pad 101 of an IC on seating surface 28*b*. When the IC is held as shown in FIGS. 2 and 3, adaptor member 28 is depressed together with IC 100 by the force of latches 22 in opposition to the force of springs 30. In this position, tip 14*c* of each contact member 14 is pushed down by a respective pad 101 of the IC, with a result that the force of contact between the pad and the contact member 14 is increased. Details of the operation of the contact members 14 as IC 100 is being depressed will be described infra.

Figure 4:
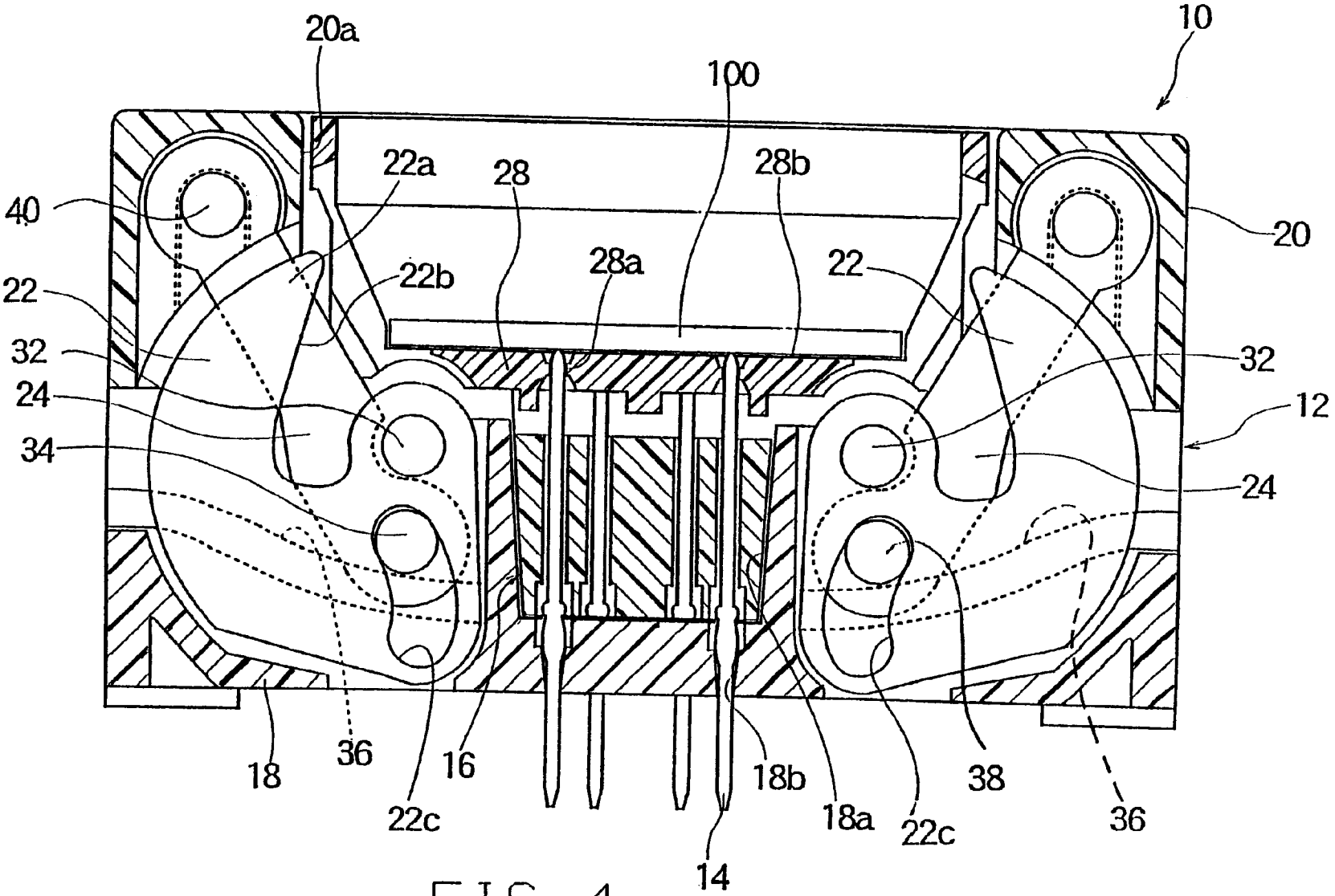
FIG. 4 is a view similar to FIG. 2 but showing the FIG. 1A socket with the IC released.

Next, latches 22 and their operation will be explained. Each latch 22 is formed of an electrically insulating material such as plastic and has a selected length that extends along one of the sides of IC 100 (see FIGS. 1A, 3 and 5) and, at the same time, its front elevation has a shape similar to the claw of a crab (see FIGS. 2 and 4). As shown in FIGS. 2 and 4, latches 22 are arranged to face each other along two opposing sides of IC 100 and are rotatably supported on base 18 by means of respective shafts 32. Each shaft 32 has both ends thereof installed in base 18 at a location lower than seating surface 28*b* of adaptor member 28. A recessed portion 22*b* is formed on each latch 22 to avoid interference with adaptor member 28 as well as IC 100 so IC 100 can be depressed from above by tip 22*a* as shown in FIG. 2 despite the position of the rotational fulcrum of shaft 32. Two pairs of links 24 extend generally vertically downwardly supported by shafts 40 on cover 20 with each pair connected at their bottom portions to opposite ends of a respective latch 22. An elongated slot 22*c* is provided in each latch 22 and a shaft 34 that is installed at the lower end portion of each link 24 is movably received through the slot. Slots 22*c* of latches 22 extend in such a direction that the respective shaft 34 can generally approach or move away from shaft 32 of the respective latch 22. When latches 22 are closed as shown in FIG. 2, shafts 34 are located at the outer extremity of slots 22*c* at a position which is furthest away from shafts 32 and links 24 are approximately in a vertical position. When latches 22 are opened as shown in FIG. 4, shafts 34 are located at the inner extremity of slots 22*c*, or a position which is close to the respective shafts 32 with the bottom portion of links 24 pulled inwardly so that the links are tilted from the perpendicular direction. A guide groove 36 is formed in base 18 for guiding the bottom of each link 24 and respective shaft 34, i.e., connecting point, when cover 20 is moved. When cover 20 is pressed downwardly from the FIG. 2 to the FIG. 4 positions, the lower end of links 24 and both ends of the respective shafts 34 are guided toward the center of base 18 along the bottom surface of the respective guide groove 36 toward a position below the respective shaft 32. When cover 20 has been raised upwardly as shown in FIG. 2, they are guided toward the outside of base 18 along the bottom surface of guide grooves 36. The bottom surface of guide grooves 36 comprise two steps for the purpose of guiding the lower end of links 24 and shafts 34.

Next, the procedures for mounting IC 100 on socket 10 and the operation of the socket will be explained. When no external force is applied to cover 20, socket 10 is in the state shown in FIGS. 2 and 3. For the purpose of this explanation, it is assumed that IC 100 has not yet been received on the socket. In this state, cover 20 is in the raised position relative to base 18 by the force of springs 21 and latches 22 are closed. When cover 20 is pressed downwardly toward base 18 by an automatic unit, not shown in the drawing, the bottom of links 24 start on their guided path toward the center of the base in conformity with guide grooves 36. Along with movement of the lower end of links 24, latches 22 tart their outwardly rotation. Shafts 34 of links 24 that have been guided by slots 22*c* gradually move toward the respective shaft 32 of the latches. When cover 20 has completed its downwardly movement as shown in FIGS. 4 and 5, latches 22 are rotated approximately 90°, with their tips 22*a* completely removed from the seating surface of adaptor member 28. Socket 10 can then receive IC 100 from above. In this state, adaptor member 28 has been raised upwardly by the force of springs 30.

The IC 100 that is supplied onto adaptor member 28 through opening 20*a* of cover 20 is positioned and arranged on the seating surface 28*b* with each pad 101 of the IC 100 lightly engaging the tip 14*c* of a contact member 14 that extends through a respective receiving hole 28*d* of adaptor member 28. When the downward force on cover 20 is removed, the cover rises due to the force of springs 21 pulling links 24 upwardly and their bottom portions shifting toward the outside of base 18 in conformity with guide groove 36. Along with this, latches 22 are rotated about shafts 32 with their tips 22*a* extending toward the top of IC 100 and finally pressing down IC 100 from above as shown in FIGS. 2 and 3. Because of the compressive force from latches 22, adaptor member 28 is pushed down against the force of springs 30 so that the curve of each contact member 14 at intermediate portions 14b is increased along with the contact force with the respective pads 101 of the IC.

Details of contact members 14 in the FIGS. 5 and 3 positions are shown respectively in FIGS. 7A and 7B. Each receiving hole 28*d* is enlarged along its width on the seating surface side at 70 and has an enlarged tapered opening 72 on the side opposite to seating surface 28*b*. Accordingly, tip 14*c* of each respective contact member 14 is held by a narrow supporting neck part 74 located between the enlarged openings 70 and 72. Due to the curve of each curved part 14*b* conforming to the vertical movement of adaptor 28, the orientation of each tip 14*c* shifts laterally, albeit slightly, using support part 74 as a fulcrum. In other words, the point of engagement of contact members 14 with pads 101 shift because of the enlarged opening at 70. When adaptor 28 has been lowered, therefore, tips 14*c* of contact members 14 move horizontally, while maintaining their engagement with the respective pads 101 of IC 100 as shown in FIG. 7B. As a result of this, tips 14*c* of the contact members wipe the surfaces of pads 101. Because of this wiping acting, the electrical reliability of the connection at the tips is enhanced.

Figure 6:
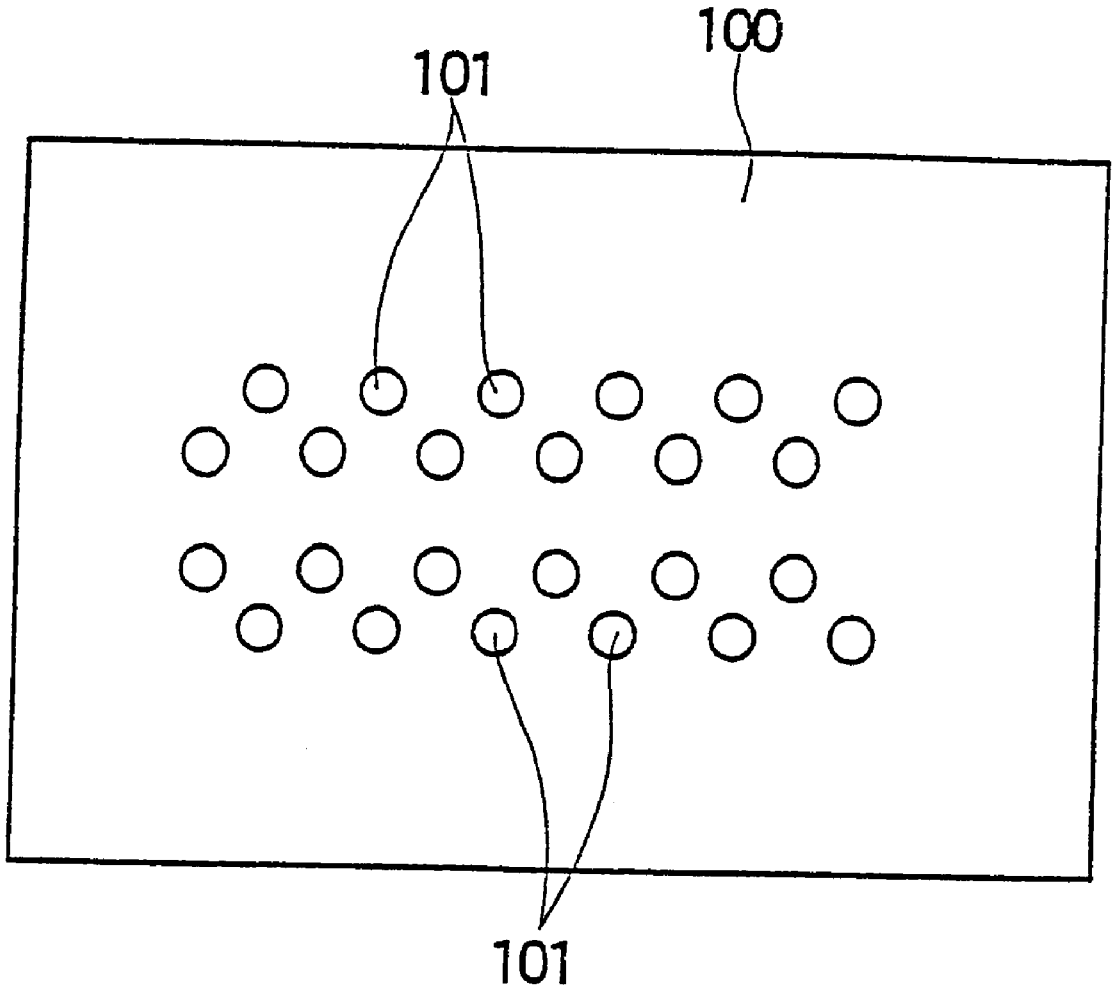
FIG. 6 is a bottom plan view of an IC that is to be mounted on a socket made in accordance with the invention.
Figure 8:
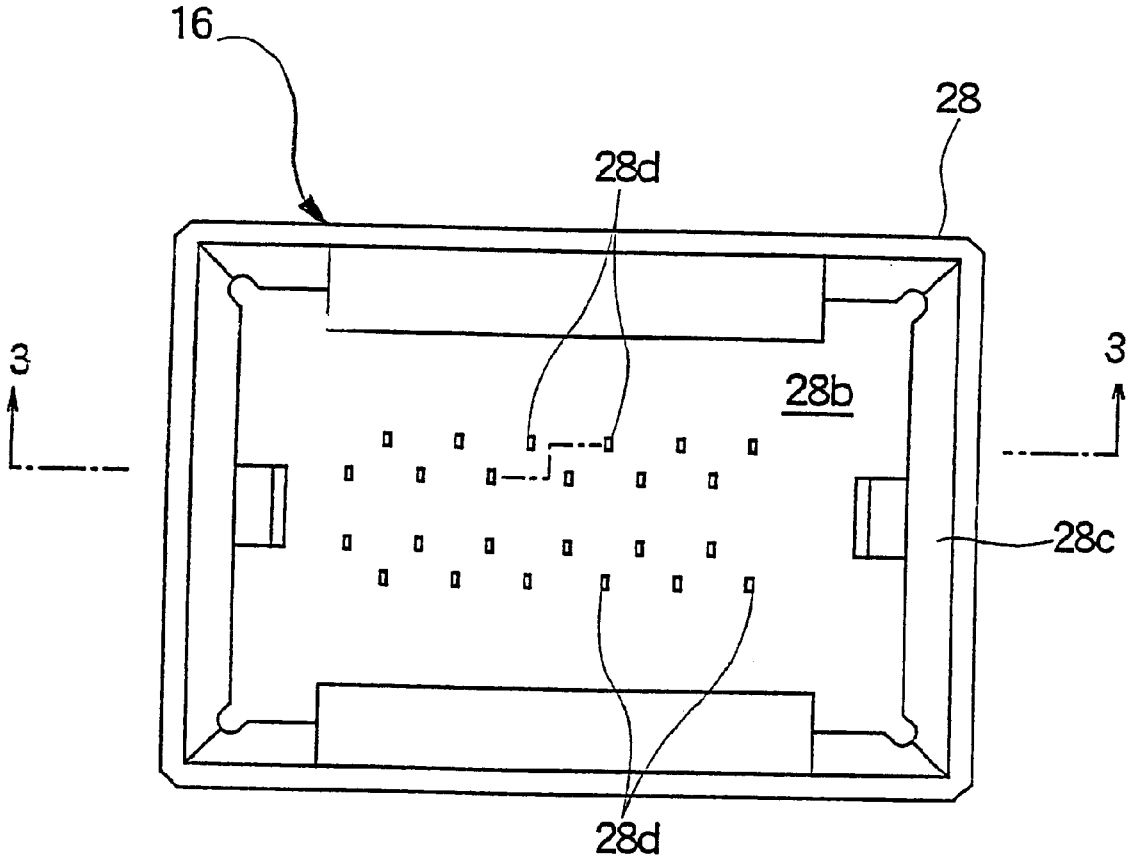
FIG. 8 is a top plan view of an adaptor used in the FIG. 1A socket.
Figure 9A:
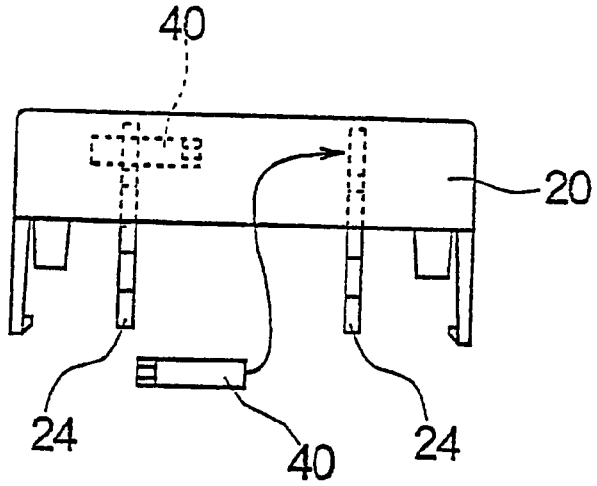
FIGS. 9A–9E are schematic illustrations used in conjunction with a description of steps taken in assembling the base assembly.
Figure 9B:
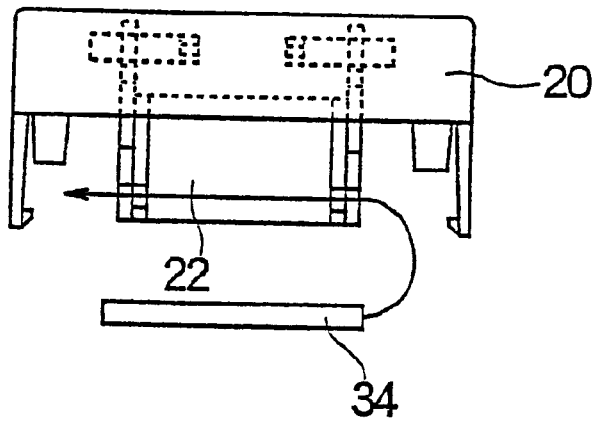
Figure 9C:
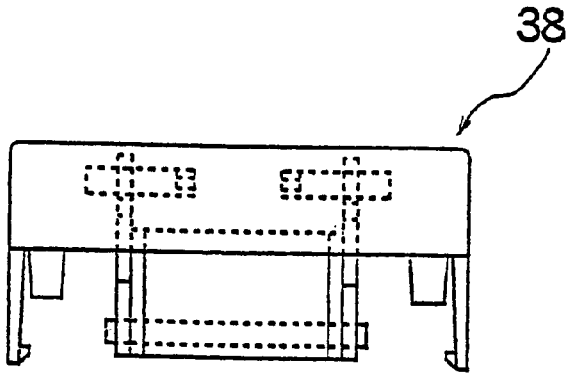
Figure 9D:
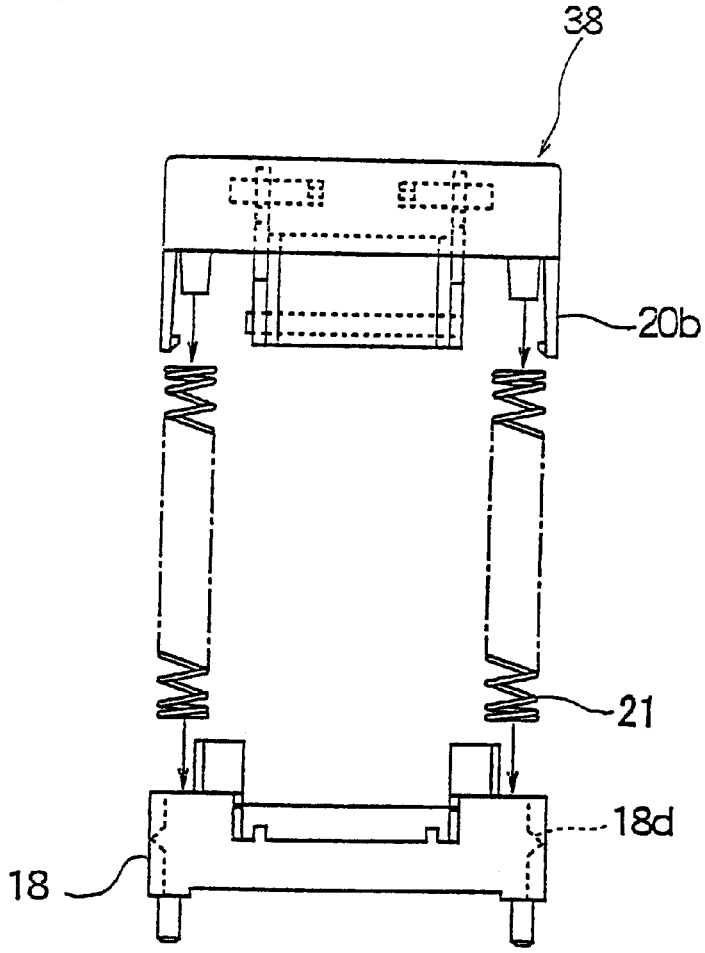
Figure 9E:
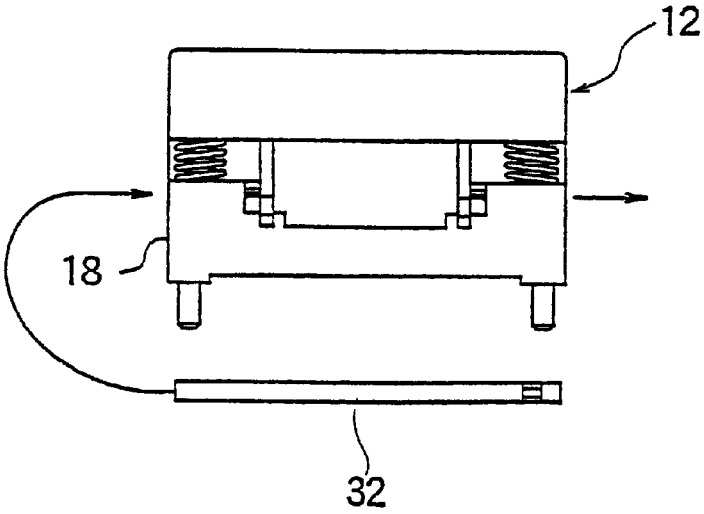

FIG. 8, a plan view of adaptor assembly 16, shows adaptor member 28 with seating surface 28*b* for IC 100, walls 28*c* around the seating surface and the receiving holes 28*d* for the contact members formed in the seating surface. The receiving holes 28*d* on the seating surface 28*b* are arranged in four rows in the longitudinal direction at locations in conformity with the pads 101 of IC 100 as shown in FIG. 6. Tip 14*c* of each contact member 14 is inserted in a respective receiving hole 28*d*, as described earlier, subsequent to the preparation of the adaptor assembly; however, the contact members are disposed so that the curved portions 14*b* extend in different directions in the two rows of receiving holes on the outside and the two rows of receiving holes on the inside. In other words, the curved part 14*b* of each contact member 14 is inserted in such a way as to form a convex configuration in a first or right-hand direction for the two rows of receiving holes 28*d* on the outside, while the curved part 14*b* is inserted in such a manner as to form a convex configuration in the opposite, second or left hand direction for the two rows of receiving holes 28*d* on the inside. This is clearly shown in FIGS. 3 and 5 which show the cross section taken along line 3—3 in FIG. 8 showing the adaptor assembly 16. The wiping at tips 14*c* of the contact members tend to move IC 100 in a given direction. In a case where the orientation of the curved portions of the contact members 14 is the same, despite the fact that IC 100 is held by latch 22, a positional shift of the IC 100 can occur thereby making it impossible to effectively achieve optimum effect of the wiping. Thus, by changing the orientational direction of the contact members 14 as described above, the forces for causing the positional shift on the part of IC 100 are offset.

Next, the assembling of socket 10 will be explained below by referring to FIGS. 9A through 12. Socket 10 is composed of base assembly 12 and adaptor assembly 16, with each assembly being built in parallel, followed by the incorporation of the adaptor assembly into the base assembly. FIGS. 9A–9E show the procedures for assembling base assembly 12. In the initial assembly step, FIG. 9A, four links 24 are installed on cover 20 by using shafts 40. In the assembly step FIG. 9B, latches 22 are arranged between a respective pair of links 24, and as shaft 34 is inserted into each respective pair, cover 20 is attached to the latches. In this manner, the cover assembly 38 is completed. In the next assembly step, FIG. 9D, cover assembly 38 is installed on base 18 through four springs 21. In this case, stop surface 20*b* on the sides of the cover are engaged with stop surface 18*d* on the sides of the base, with a result that cover assembly 38 is attached in such a manner as to be capable of vertical movement relative to base 18. In the assembly step FIG. 9E, rotary shaft 32 is inserted from the side of base 18 and each latch 22 is rotatably installed on base 18. In this manner, the assembly is completed.

Figure 10A:
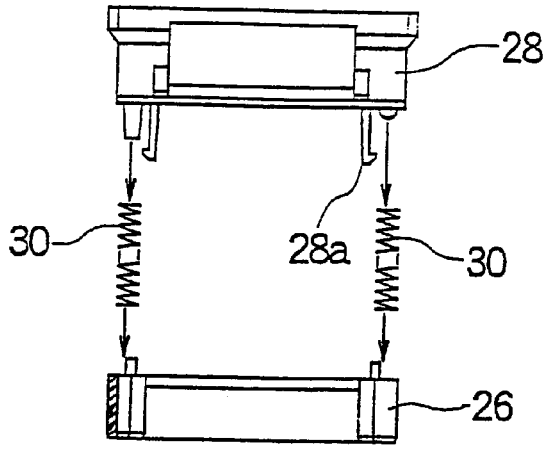
FIGS. 10A–10C are schematic illustrations used in conjunction with a description of steps taken in assembling the adaptor assembly.
Figure 10B:
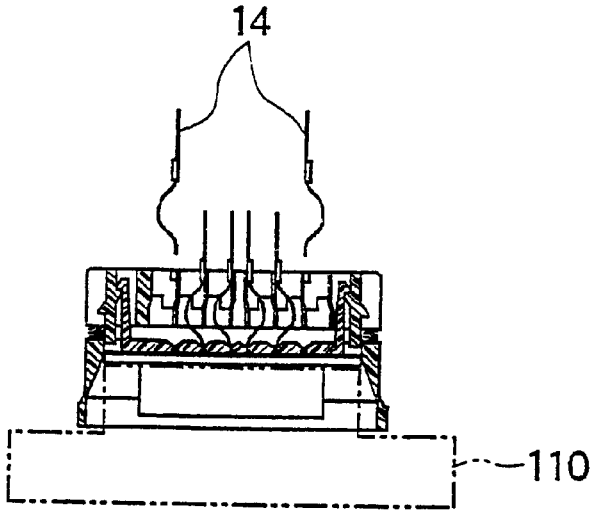
Figure 10C:
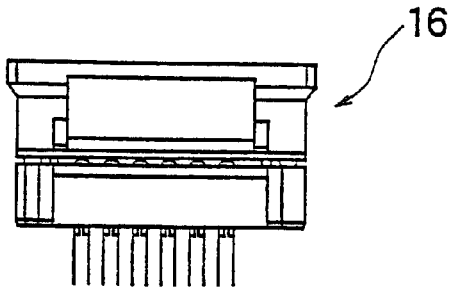

FIGS. 10A–10C show the order of the assembling of adaptor assembly 16. In the initial assembling step FIG. 1A, adaptor member 28 is installed on mounting block 26 through four springs 30. In this connection, engaging latch 28*a* on the sides of the adaptor member engage with the engaging latch 26*c* (not shown in FIG. 10A) on the side of the mounting block, thereby making it possible for adaptor member 28 to be mounted on mounting block 26 in such a fashion as to be vertically movable relative to the mounting block.

Figure 11A:
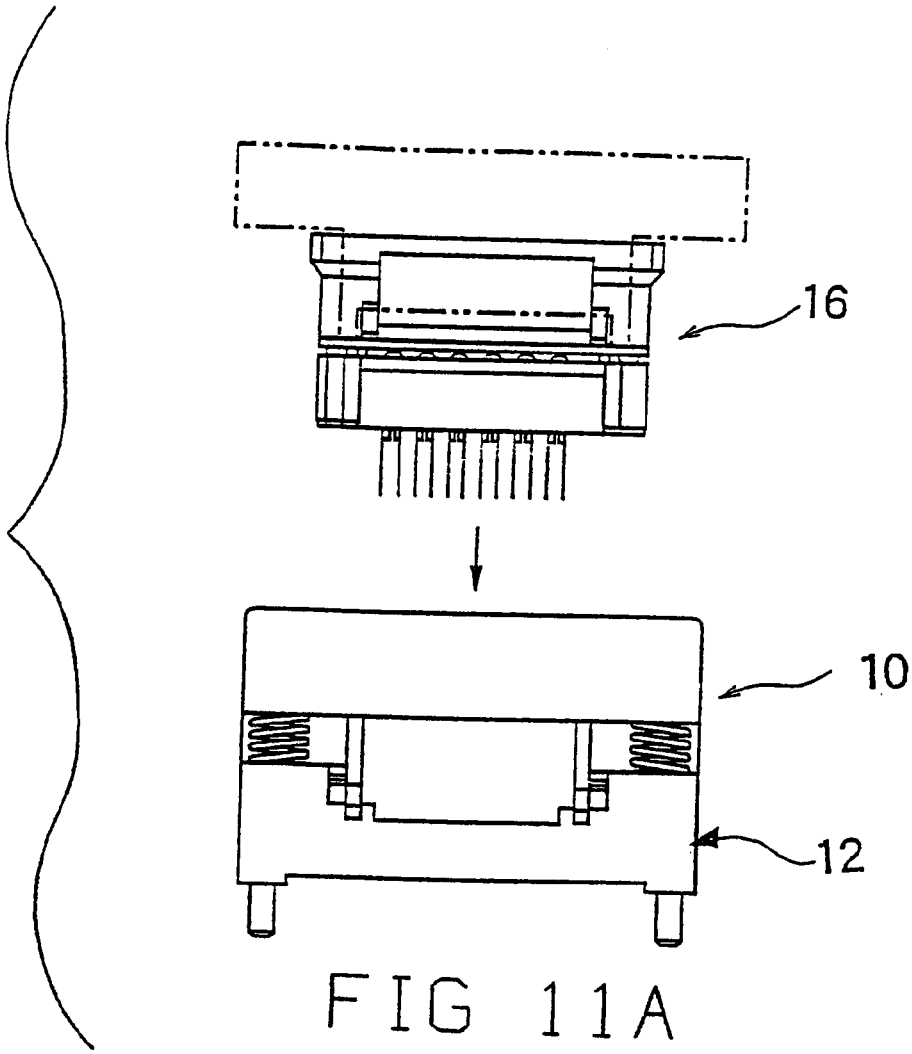
FIGS. 11A and 11B are schematic illustrations used in conjunction with a description of steps taken in assembling the socket.
Figure 11B:
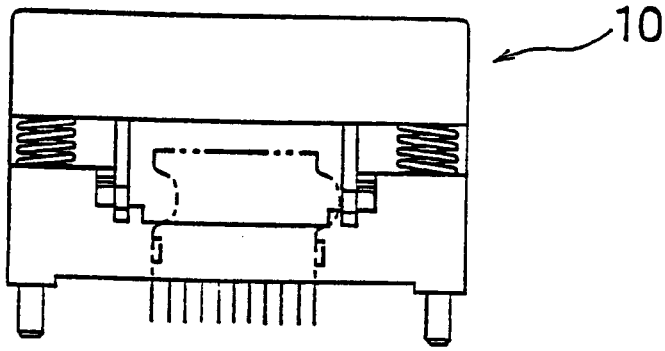

In the assembly step FIG. 10B, the mounting block and adaptor member are inverted and contact members 14 are placed inside mounting block 26 by employing a pedestal 110. In this manner, the adaptor assembly 16 is completed as seen in FIG. 10C. FIGS. 11A, 11B show the final assembling steps for socket 10. With reference to FIG. 11A, the adaptor assembly 16 that has been assembled as shown in FIG. 10C is incorporated, from above, into base assembly 12 that has been assembled in the steps shown in FIGS. 9A–9E above. At this juncture, the engagement latch 18*c* on the side of the base assembly and the engagement latch 26*b* on the side of the adaptor assembly are engaged with each other. (Reference should be made to FIGS. 3 and 5.)

In this manner, socket 10 is finally assembled as indicated in FIG. 11B. Thus, the assembling of base assembly 12 (in steps shown in FIGS. 9A–9E) and the assembling of adaptor assembly 16 (in steps shown in FIGS. 10A–10C) can be carried out in parallel, thereby achieving high assembly efficiency.

Figure 12:
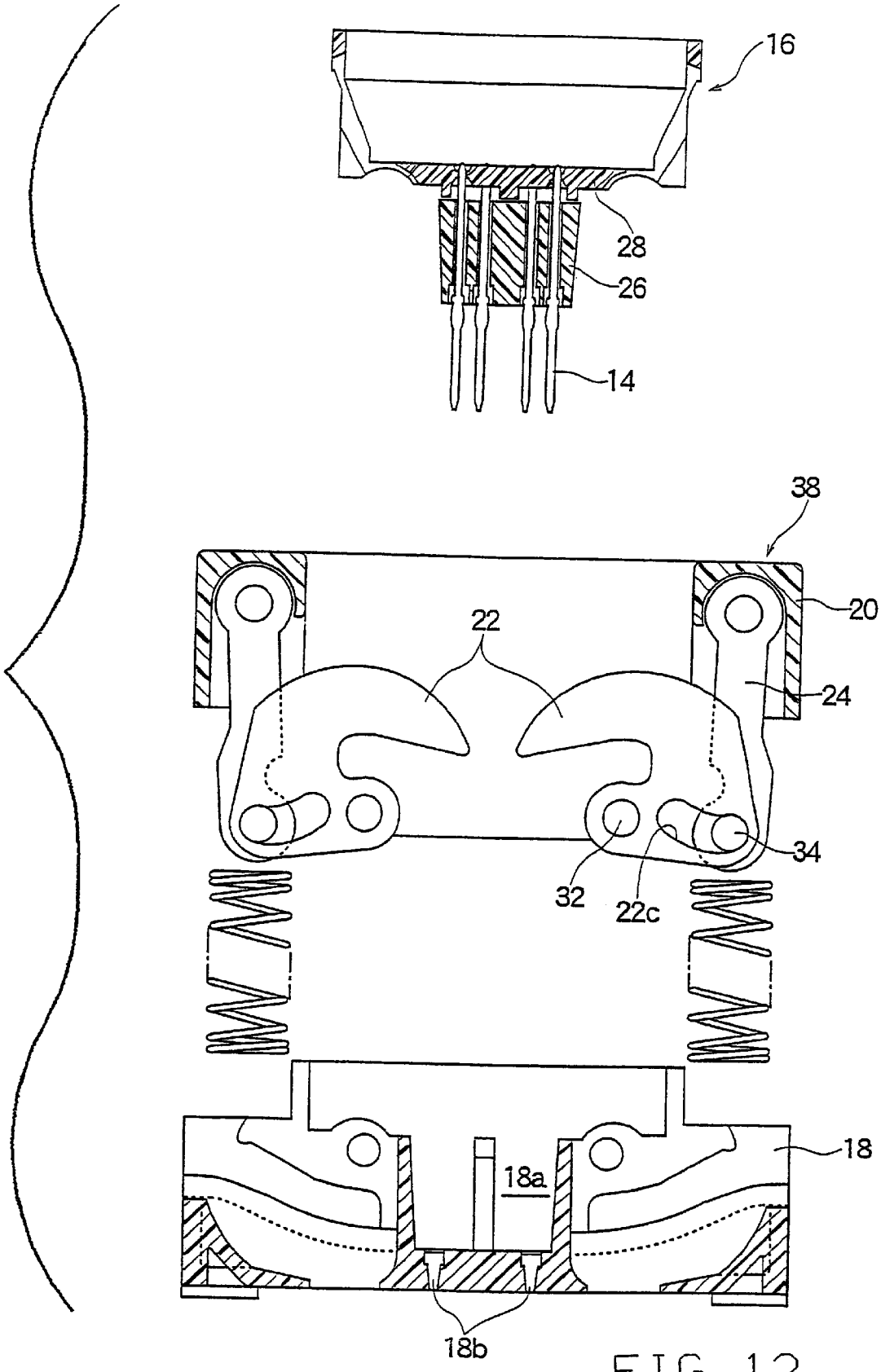
FIG. 12 is an exploded cross sectional view of components of the socket as shown in FIG. 2.
Figure 13:
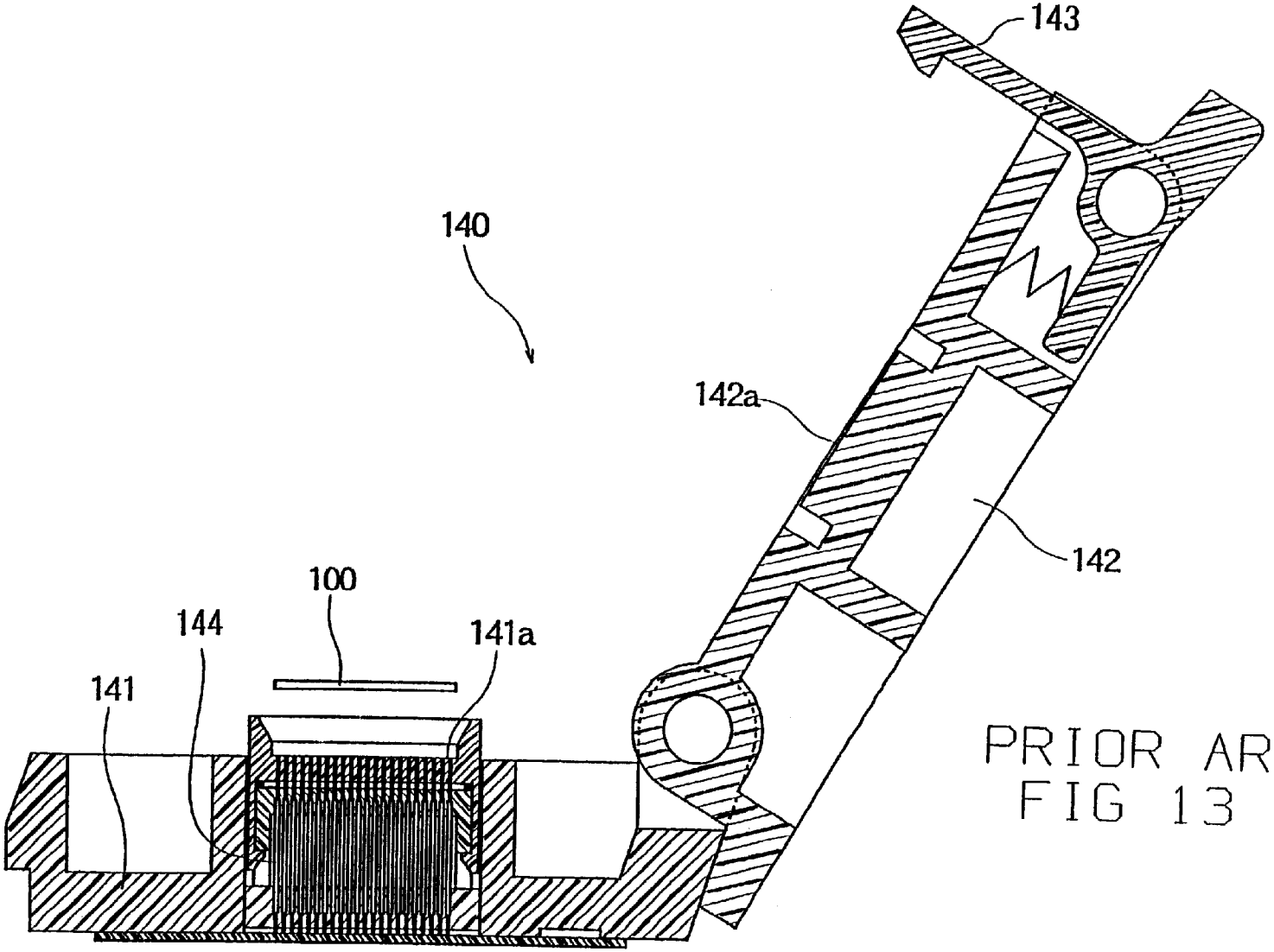
PRIOR ART FIG 13
FIG. 13 is a cross sectional view of a prior art electrical socket shown with the cover in the raised position.
Figure 14:
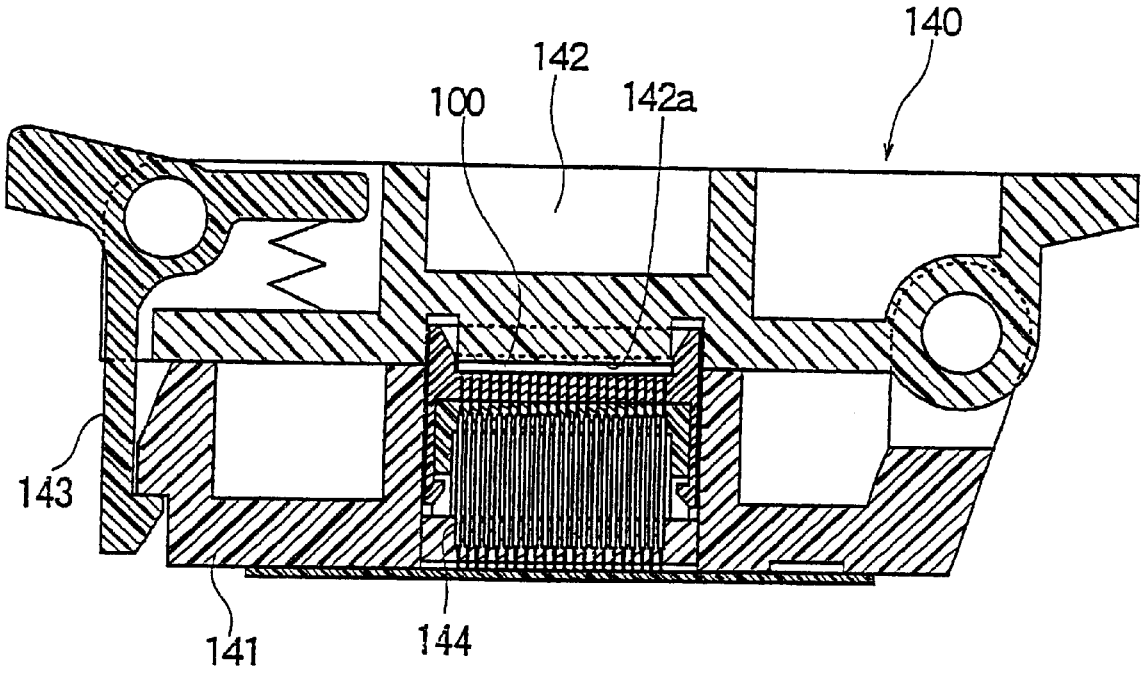
PRIOR ART FIG 14
FIG. 14 is a cross sectional view similar to FIG. 13 but showing the prior art socket with the cover closed.

A drawing of socket 10 corresponding to FIG. 2 is shown in FIG. 12 showing adaptor assembly 16, cover assembly 38 and base 18 separated from one another. Cover assembly 38 is installed on base 18 in accordance with the steps described earlier and adaptor assembly 16 is then installed.

The preferred embodiment of this invention has been explained above by referring to the attached drawings. It is obvious that the scope of the invention is not intended to be limited to the specifics of what has been described in the above embodiment. In the described embodiment, a socket for an IC whose number of terminals is comparatively small was used. However, it will be clear to those in the industry that sockets made according to the invention can also be used with IC's having a greater number of terminals.

According to the invention which has been explained in detail above, the outside shape of the socket as compared with the size of the IC to be tested can be decreased. According to the invention, the socket is composed of a plurality of assemblies, with a result that the time required for assembling the socket can be shortened. Further, according to the invention, the wiping at the tip of the contact maker can be carried out effectively and, accordingly, the connective reliability for the IC terminals can be improved.

It is the intention that the invention include all modifications and equivalents of the disclosed embodiment falling within the scope of the claims.

What is claimed:

1. A socket for use with a semiconductor device having a plurality of terminals on at least one surface comprising a base, an adaptor member received on the base having a seating surface for a semiconductor device, the adaptor member having a plurality of contact member receiving holes extending through the seating surface, a plurality of contact members having tips received in each of the contact member receiving holes to be placed in contact with each terminal of the semiconductor device placed on the seating surface, a rotary latch having a rotational axis fixed to the base and having an opened position away from the seating surface to enable the semiconductor device to be placed on the seating surface of the adaptor member and a closed position at the seating surface to enable the semiconductor device on the seating surface to be held from above, a cover which is arranged on the base and supported for movement between a first position which is close to the base and a second position which is separated from the base, and a link having one coupling mechanism connecting the link to the cover and another coupling mechanism connecting the link to the rotary latch which opens the rotary latch when the cover is at the first position and closes the rotary latch when the cover is at the second position, the coupling mechanism connecting the link to the rotary latch comprising a slot in the rotary latch which extends generally toward and away from the rotational axis of the rotary latch.

2. A socket according to claim 1 further comprising a spring for biasing the cover toward the second position.

3. A socket according to claim 1 wherein the base is formed with a guide surface for guiding the coupling mechanism of the link to the rotary latch to a position which is located closer to the rotational axis of the rotary latch when the rotary latch is opened and to a position which is separated from the rotational axis of the rotary latch when the rotary latch is closed.

4. A socket according to claim 1 wherein the base has four sides and a rotary latch is provided on at least two opposing sides of the base.

5. A socket according claim 1 further comprising a mounting block that holds the plurality of contact members, the mounting block being fixed to the base, the adaptor member being movable toward and away from the mounting block and a spring member biasing the adaptor member in a direction away from the mounting block.

6. A socket according to claim 1 wherein the rotational axis of the rotary latch is positioned below the seating surface of the adaptor member.

7. A socket according to claim 6 wherein a straight line distance between the coupling mechanism of the link to the cover and the rotational axis of the rotary latch varies in conformity with the position of the cover.

8. A socket according to claim 1 wherein the contact members have a convex configuration along their length with the tip parts being forced downwardly into the contact member receiving holes when the semiconductor device is placed on the seating surface, some of the plurality of contact members having the convex configuration facing in a first direction and other contact members having the convex configuration facing in second, different, direction.

9. A socket according to claim 8 in which the plurality of contact members are arranged in a plurality of rows, with the convex configuration facing in the same direction in a given row.

10. A socket according to claim 8 further comprising a mounting block fixed to the base, the adaptor member being movable toward and away from the mounting block and a spring member placing a bias on the adaptor member in a direction away from the mounting block.

11. A socket as described in claim 8 in which approximately half of the plurality of contact members have their convex configuration facing in the first direction and approximately the remaining half have their convex configurations facing in the second, different, direction.

12. A socket according to claim 11 in which the first direction and second, different, direction are opposite to each other.

* * * * *